US006640575B2

(12) United States Patent
Word

(10) Patent No.: US 6,640,575 B2
(45) Date of Patent: Nov. 4, 2003

(54) APPARATUS AND METHOD FOR CLOSED CIRCUIT COOLING TOWER WITH CORRUGATED METAL TUBE ELEMENTS

(76) Inventor: Mac Word, 1903 Westridge, Austin, TX (US) 78704

( * ) Notice: Subject to any disclaimer, the term of this patent is extended or adjusted under 35 U.S.C. 154(b) by 0 days.

(21) Appl. No.: 10/062,917

(22) Filed: Feb. 1, 2002

(65) Prior Publication Data

US 2003/0145619 A1 Aug. 7, 2003

(51) Int. Cl.[7] ..... F28D 5/00

(52) U.S. Cl. ..... 62/314; 62/310; 62/305; 165/133

(58) Field of Search ..... 62/310, 314, 315, 62/305, 435, 260, DIG. 16; 165/65, 133, 10, 104.11

(56) References Cited

U.S. PATENT DOCUMENTS

| | | | | | |
|---|---|---|---|---|---|
| 2,059,839 | A | * | 11/1936 | Ashley | 62/171 |
| 3,052,105 | A | * | 9/1962 | Bowman et al. | 62/305 |
| 4,367,631 | A | * | 1/1983 | Johnson et al. | 62/79 |
| 4,448,238 | A | * | 5/1984 | Singleton et al. | 165/45 |
| 4,516,721 | A | * | 5/1985 | Laing et al. | 237/69 |
| 4,574,877 | A | * | 3/1986 | Klein | 165/104.33 |
| 4,733,331 | A | * | 3/1988 | Chauvet | 361/700 |
| 4,951,739 | A | * | 8/1990 | Cates et al. | 165/10 |
| 4,974,422 | A | * | 12/1990 | Kocher | 62/305 |
| 5,501,269 | A | | 3/1996 | Jenkins | |
| 6,070,426 | A | * | 6/2000 | Sakashita et al. | 62/305 |
| 6,119,769 | A | * | 9/2000 | Yu et al. | 165/109.1 |
| 6,122,922 | A | | 9/2000 | Conner | |
| 6,142,219 | A | * | 11/2000 | Korenic et al. | 165/110 |
| 6,213,200 | B1 | * | 4/2001 | Carter et al. | 165/285 |
| 6,250,610 | B1 | | 6/2001 | Flaherty | |
| 6,460,520 | B1 | * | 10/2002 | Challis | 165/52 |

OTHER PUBLICATIONS

Press Release—"Water Cooled Air Conditioner Could be a Hit in Las Vegas".

* cited by examiner

*Primary Examiner*—Chen Wen Jiang
(74) *Attorney, Agent, or Firm*—Rick B. Yeager

(57) ABSTRACT

A closed circuit cooling tower for evaporative fluid cooler applications such as water-cooled residential and commercial air conditioning, geothermal cooling supplementation, and process cooling applications. Corrugated metal tubes are used for heat transfer to permit mechanical de-fouling, such as flexing the tubes. The cooling tower may operate at high dissolved solids, or gray water may be used in order to reduce water consumption. The cooling tower is lightweight and modular to permit retrofitting of existing rooftop air conditioning systems so that efficient evaporative cooling may be used to lower energy costs.

32 Claims, 7 Drawing Sheets

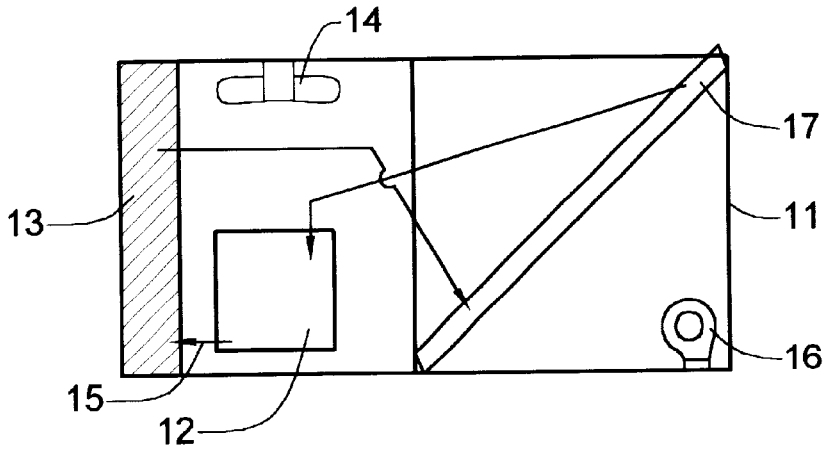
FIG. 2A
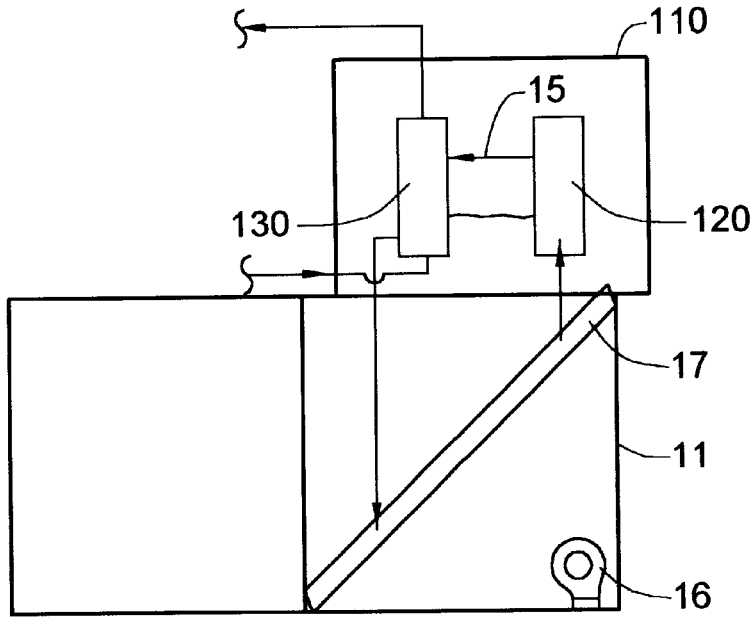
FIG. 2B
*FIG.2*

APPARATUS AND METHOD FOR CLOSED CIRCUIT COOLING TOWER WITH CORRUGATED METAL TUBE ELEMENTS

BACKGROUND

1. Field of Invention

This invention relates to a method and apparatus for an evaporative fluid cooler as a closed circuit cooling tower where corrugated metal tube heat transfer elements are used to cool the fluid in the closed loop.

2. Description of the Prior Art

The prior art includes the use of closed loop cooling towers for applications including commercial air conditioning, and process cooling.

Commercial air conditioning, particularly in the southwestern United States, is a substantial portion of overall electrical power demand. Most commercial air conditioning equipment is installed as air-cooled roof top package units, where the radiant and reflective heat from the roof deck substantially reduces the performance of the equipment. The use of water cooling rather than air cooling can dramatically improve the efficiency of the equipment because the water temperatures may be as much as 50 degrees cooler than the roof top air, and because of the large heat load that may be removed through the evaporation of water. The dramatic reduction in condensing temperatures possible with evaporative fluid coolers, or closed circuit cooling towers can result in cooling efficiency increases on the order of 50% and higher. These savings result in significant savings of peak kilowatt power.

The performance of an evaporative cooling device is optimized at elevated temperatures when the demand for power is greatest, and the performance of conventional air cooled units is greatly diminished.

One embodiment of the current invention is a water cooled system which may be retrofitted to existing roof top systems in order to increase the operating efficiency of this equipment by as much as sixty percent. The retrofit package is comprised of a specially designed closed loop cooling tower, piping manifold, and compressor modules to upgrade the existing systems.

Cooling towers have been used for large chilled water systems for air conditioning for many years. More recently, cooling towers have been employed on smaller commercial and residential systems.

Vendors of prior art cooling tower equipment include Marley Cooling Towers (www.marleyct.com) and Delta Cooling (www.deltacooling.com)

U.S. Pat. No. 6,250,610 issued Jun. 26, 2001 to Flaherty describes a molded cooling tower for industrial process cooling and air conditioning systems. The cooling tower includes a molded tower shell and supports for a filler material.

U.S. Pat. No. 5,501,269 issued Mar. 26, 1996 to Jenkins describes a fiberglass cooling tower with an uplift air flow.

U.S. Pat. No. 6,122,922 to Conner, issued Sep. 26, 2000, describes a closed loop cooling tower with three modes of operation including direct air-cooled, direct liquid cooled, and indirect evaporative liquid cooled. One of the reasons for the complexity of that invention was to reduce the consumption of water in the cooling tower.

There is a need for a relatively simple and inexpensive closed circuit cooling tower that can conserve water by utilizing higher total dissolved solids water coolant, by utilizing untreated water, and can be operated without extensive chemical treatment of the coolant water in the tower. The application of evaporative cooling technology in light commercial and residential applications demands a low maintenance system. The design must allow service by untrained personnel at irregular internals. There is a need for a method and apparatus for the simple mechanical cleaning of heat exchange tubes in a closed circuit cooling tower by simple mechanical flexing of a corrugated stainless steel heat exchanger. The system should allow for freeze protection without the need for seasonal service and draining.

SUMMARY OF THE INVENTION

The current invention is a closed circuit cooling tower for evaporative fluid cooler applications such as water-cooled residential and commercial air conditioning, geothermal cooling supplementation, and process cooling applications. Typically, a first fluid which may be treated water or other fluids, is circulated between the closed circuit cooling tower and an application such as a condenser heat exchanger. Heat is transmitted from the application to the first fluid, and heat is removed from the first fluid at the cooling tower.

At the cooling tower, the first fluid is directed to a plurality of cooling tubes so that the fluid flows through the cooling tubes before being returned to the application. Heat flows from the first fluid through the walls of the cooling tube, and is partially removed by the evaporative cooling of a second fluid of the cooling tube. The second fluid is preferably water or non-potable gray water. In order to control corrosion and fouling, prior art cooling towers typically either treat the second fluid, or they have relatively high volumes of "blow-down" where a portion of the second fluid is removed, and fresh fluid is added.

In the current invention, the second fluid is preferably not treated, and preferably has little or no blow-down during operation. In the current invention, the second fluid can be untreated water, gray water, sea water or brackish water not suited for other applications. The design provides for very low maintance, low water consumption, due to its ability to handle very high concentrations of solids. The operating performance in the semi-arid regions is complemented by the fact that the machine conserves water relative to other evaporative devices.

The tubes are preferably flexible so that fouling can be mechanically removed by twisting and otherwise moving the tubes. A corrugated stainless steel tubing is a material which may be used effectively as heat exchanger tubes. The corrugations provide strength and flexibility during the cleaning operations, and they enhance the heat exchange at the outside surface of the tube. The stainless steel is resistant to corrosion, and can be subjected to acid cleaning without damage.

The current invention addresses the cost, maintenance, and water quality issues which have inhibited the acceptance of water-cooled units. An embodiment of the current invention is to use existing roof top units in place and to modify the units by installing a downsized compressor module with a freon to water heat exchanger. In one embodiment, the closed circuit cooling tower is installed with a piping loop to tie in all compressor modules to the closed loop. The units are converted from air-cooled systems to water-cooled units resulting in substantial energy savings and enhanced service life.

An embodiment of the current invention is a closed tower with a stainless steel heat exchanger design. The closed tower design allows for routine operation at much higher levels of total dissolved solids, or higher mineral concentrations than prior art cooling towers. This ability to run higher dissolved solids results in a dramatic reduction in blow down water losses, or bleed off to control mineral concentrations.

The flexible stainless steel heat exchanger can be cleaned of minerals by simply flexing each heat exchanger loop in a twisting motion. The mineral build up will break free and fall off of the heat exchanger.

The components in the cooling tower are preferably fiberglass, plastic, and stainless steel. This unique design allows for routine acid cleaning without damage to the tower or its components. The corrosion resistant materials of this equipment in areas with hard water consistent with many desert regions.

The cooling tower is resistant to freeze damage. Its catch basin is designed to freeze without being damaged by the expanding water. The catch basin shape is similar to an ice tray, thus allowing for expansion without damage.

The cooling tower may use non-potable gray water for cooling without damage or service problems.

The components, particularly the fiberglass housing and the corrugated stainless steel heat exchangers are also light weight so that they may be installed on most roofs without requiring structural modifications.

BRIEF DESCRIPTION OF THE DRAWINGS

These and other objects and advantages of the present invention are set forth below and further made clear by reference to the drawings, wherein:

FIG. 2A is a cross section view of an existing rooftop unit.

FIG. 2B is a cross section view of a retrofitted rooftop unit.

DETAILED DESCRIPTION OF EMBODIMENT

Retrofit of Existing Rooftop Air Conditioning Units

Figure 1:
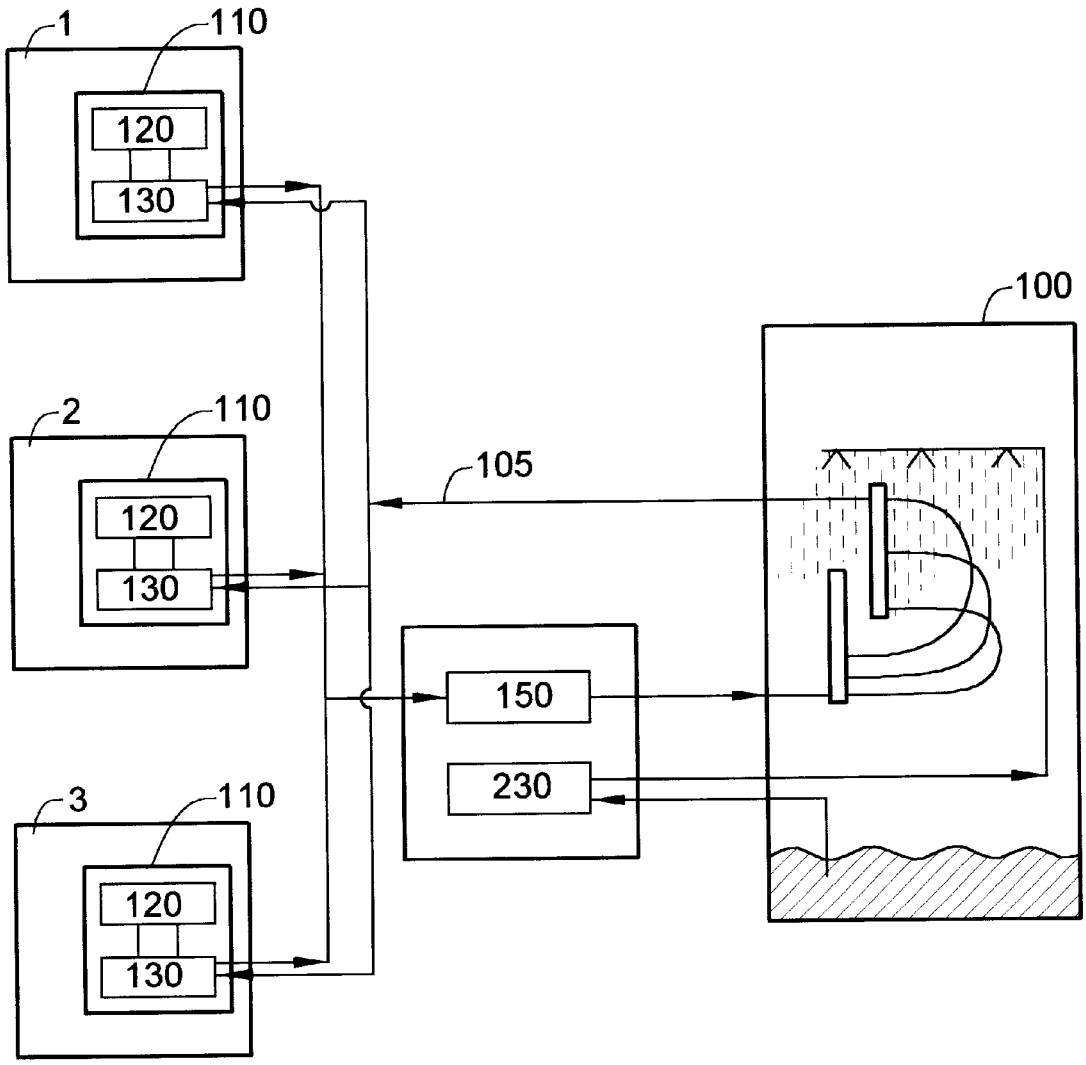
FIG. 1 is a piping schematic of a retrofitted closed loop air conditioning system.

Referring now to FIG. 1, which is a piping schematic of a closed loop system for a commercial air conditioning application, the figure illustrates three typical roof top air conditioner units 1, 2, and 3. In this example, each of these units includes a 5-ton compressor, and each unit controls a zone of air conditioning.

Referring now to FIG. 2A, which is a cross section view of an existing rooftop unit, each roof top air conditioner unit typically includes a housing 11, a 5-ton compressor 12, a condensing coil 13, and a fan 14 for pulling air across the condensing coil. In a separate compartment, air is moved by a blower 16 across an evaporative coil 17 to provide cooling to the structure below the roof.

Referring again to FIG. 1, in this embodiment, the air cooled units 1, 2, and 3 are retrofitted so that a single cooling tower 100 replaces the air cooling of the existing units. Each unit is provided with a module 110 containing a water heat exchanger 130 and a downsized 4-ton scroll compressor 120. Each heat exchanger provides a refrigerant loop, typically freon, and a condensing coolant loop, which is typically a water/glycol solution as a freeze protected heat exchange fluid. Alternately, a brine or other coolant may be used.

Referring now to FIG. 2B, which is a cross section view of a retrofitted rooftop unit, the module 110 may be secured to the top of the housing 11. The plumbing is re-routed so that freon 15 flows from the compressor 120 to the water heat exchanger 130 and then to the evaporator coil 17. The old fan, old compressor, and condensor coils may be left in place or removed.

Referring again to FIG. 1, the closed circuit cooling tower 100 is an evaporative fluid cooler, which utilizes evaporation to cool the heat transfer fluid to well below the ambient temperature. A pump module 150 is used to pump the condensing water fluid 105 from the is cooling tower to the compressor/heat exchanger modules 110 where it is directed through the heat exchangers to cool and condense the refrigerant, referred to in this description as freon. The temperature of the water-cooled freon is typically substantially cooler, usually 40 to 60 degrees F, than the temperature of the freon which could be obtained in the air-cooled unit. This lower freon temperature permits a substantial increase in the efficiency of the cooling. For instance in this application, a 4-ton compressor with water-cooling can provide more cooling capacity than a 5-ton air-cooled compressor. The pump module may also house a second pump 230 for pumping water from the cooling tower sump through spray nozzles in the cooling tower.

The lower freon temperatures of the water-cooled units results in several benefits relative to air cooled units. The water-cooled units provide a substantial increase in operating efficiency. The water-cooled units permit lower refrigerant pressures, thereby reducing the work required by the compressor. The water-cooled units provide increased cooling capacity, typically 20 to 30 percent, while reducing the compressor power consumption, typically 40 to 50 percent. The water-cooled units also provide elimination of the condenser fan and its noise and power consumption. The water-cooled units also provide increased service life for the compressor, because it runs cooler and at lower pressures; as well as simple reliable controls, and very low maintenance.

Once the retrofit is complete, the roof top units are converted from air-cooled machines to water-cooled units. As described below, the cooling tower is preferably constructed of lightweight modular-designed materials in order to facilitate placement on the roof of a structure without a crane.

The harsh overheated conditions in the southwestern United States provide a serious challenge to conventional air-conditioning systems. The reflective roof deck and poor airflow of conventional rooftop installations cause air cooled units to be even more inefficient on summer days. The rooftop heat causes the air conditioning equipment to suffer with high-pressures, excessive power consumption, and a loss of cooling capacity. These conditions dramatically shorten the service life of most of the components in a typical air-cooled unit. The savings potential for the water-cooled retrofit is large in the desert regions due to the very low humidity. The evaporative effect of a cooling tower is outstanding in this dry environment. The freon condensing temperatures that can be achieved with the cooling tower are typically in the range of 85 to 90 degrees F, as compared to air-cooled condensing temperatures in excess of 130 degrees F. Operational savings of 50% or more relative to conventional systems, may be achieved.

Figure 3:
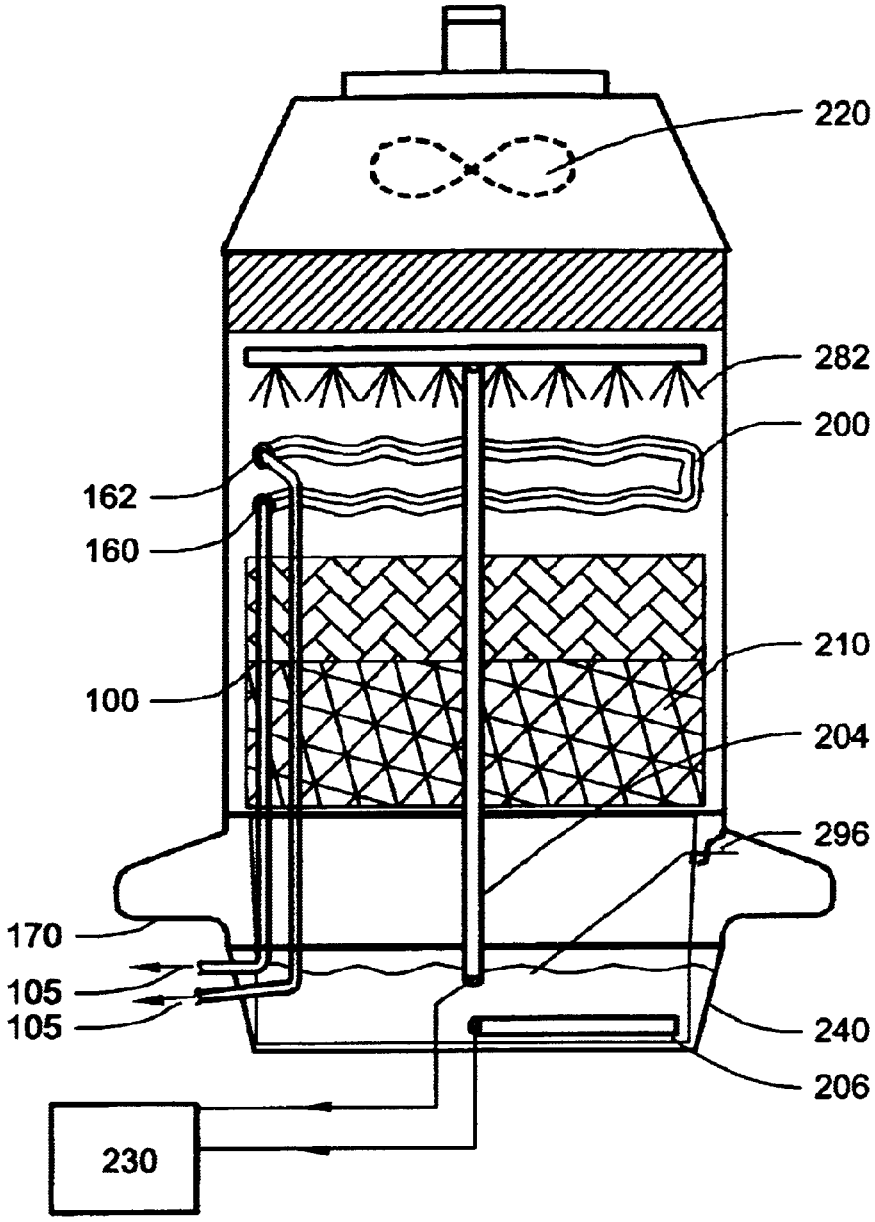
FIG. 3 is a cross section view of a cooling tower.

Referring now to FIG. 3, which is a cross section view of a cooling tower, the water based heat transfer fluid 105 is circulated through stainless steel heat exchangers 200 in the cooling tower 100. The cooling tower pump 230, which is preferably located outside of the cooling tower, pumps water 206 from a sump 240 through distribution piping 284 to spray nozzles 282 where it is sprayed over the heat exchangers and an evaporative media section 210 of the cooling tower. Air is pulled by a fan 220 from air intake ports 170 in the lower part of the housing across the evaporative media section 210. The cooling tower media provides an enhanced service area for the water and air to interface, causing evaporative cooling of the water, thus rejecting the heat to the atmosphere. The cooling tower fan 220 and pump 230 are the only moving parts in the thermal loop system.

The condensing water heat transfer fluid removes heat from the freon 15 in the retrofitted rooftop units and transfers the heat to the cooling tower to be rejected to the atmosphere. The piping loop is preferably simple and inexpensive PVC or polyethylene piping that is protected from the sun. Alternately, steel or copper piping may be used. The compressor heat exchange modules are installed in each of the rooftop units, and recharged with freon. The old condensing coils and fans are taken out of service. The invention requires no control wiring from the existing units; the system is controlled by simple thermostatic controls 300 installed in the pump module. The design provides for a quick and simple installation with minimum down time.

DETAILED DESCRIPTION OF EMBODIMENT

Fluid Cooling System

An embodiment of a closed loop cooling tower 100 is illustrated in FIG. 3, which is a detailed cross section of a cooling tower. The cooling tower includes a process fluid inlet 160 which receives the process fluid from an external device (not shown) such as an air conditioning condenser or manufacturing process equipment. In the case of a retrofit, the process fluid may be provided by a pump which delivers the fluid from one or more heat exchangers. After heat is rejected from the process fluid in the cooling tower, the process fluid exits through a process fluid outlet 162.

Although other coolant fluids or gases may be used, the process fluid typically comprises water or treated water, that is received through the inlet 160 at one temperature and discharged through the outlet 162 at a lower temperature. In this configuration, the heat exchange system comprises a fluid cooling system.

The cooling tower may also comprise a condensing system, in which case the process fluid may comprise a two-phase or a multi-phase fluid at the inlet 160 that is discharged from the outlet 162 as a single phase condensed liquid.

Air is pulled from air inlet vents 170 through a cooling tower fan at the top of the tower. An evaporative liquid 206, which is typically water, untreated water, or salt water is used to provide the cooling. The process fluid circuit 165 comprises a plurality of tube elements 200 in parallel circuits 205 of a general U-shape. Each of the circuits 205 have a first end 201 connected to a inlet fluid header 161, and a second end 202 connected to an outlet fluid header 163. The inlet and outlet headers 161 and 163 may be reversed if the heat exchange system is used as a condenser instead of as a fluid cooler.

Figure 7:
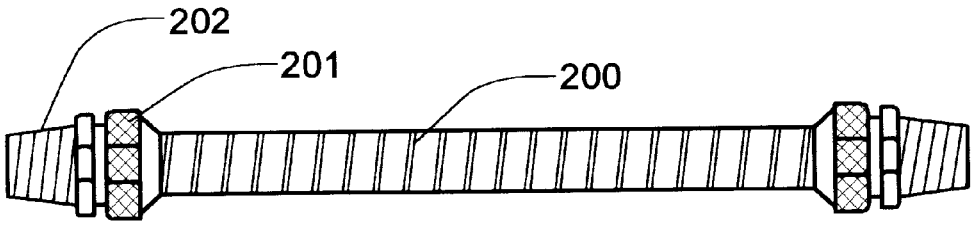
FIG. 7 is a top view of a heat exchange element.

Referring now to FIG. 7, in this embodiment, each tube element 200 consists of a continuous length of corrugated metal tubing which is bent roughly in the shape of a U so that the end of the tubing can be connected to the inlet and outlet header located on the same side of the cooling tower. The material is preferably corrugated stainless steel. In this embodiment, each end of the tubes has a threaded fitting 201 for attaching the tube to the manifolds. The corrugations 202 on the tube, which are preferably about ⅛ inches wide and ⅛ inches deep provide enhanced heat exchange surface area and permit mechanical flexing to aid in cleaning the tube. In one embodiment, the tubes may be ordered in five foot lengths with threaded fittings from various suppliers. Alternately, the tubes may be fabricated to any desired length.

Figure 4:
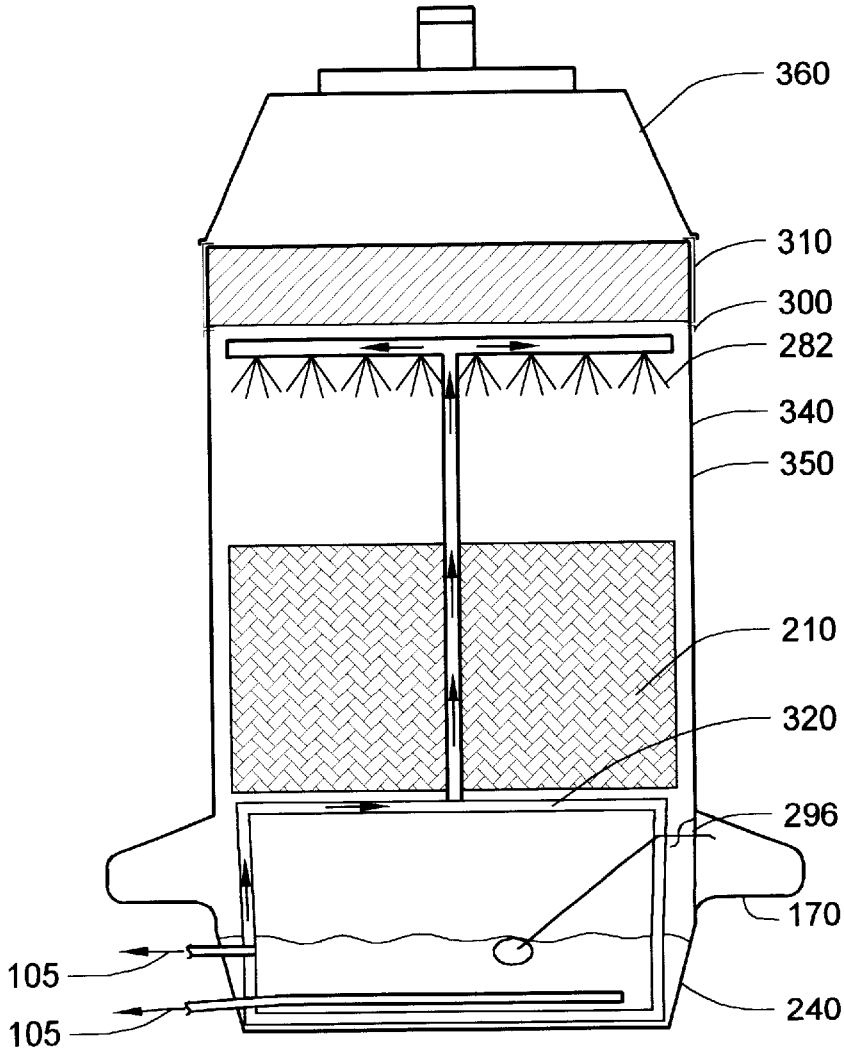
FIG. 4 is a detail of the housing.

As shown in FIGS. 3 and 4, the heat exchange system also includes a distribution system 280 for selectively distributing an evaporative liquid within the tower for evaporative heat exchange. In this embodiment, the distribution system 280 includes a plurality of spray nozzles 282 disposed above the heat transfer elements 200. The spray nozzles 282 are connected to a distribution pipe system 284, which is connected to a vertical distribution pipe 286. The vertical distribution pipe 286 is connected to a pump 230 that is connected to draw evaporative liquid from a sump 240 positioned below the heat transfer elements.

The distribution system 280 also includes a conduit 292, valve 294, or any other suitable device for introducing evaporative liquid to the apparatus; as shown in FIG. 1, in the illustrated embodiment the evaporative liquid is introduced into the sump 290. A float valve 296 maintains the water level and provides makeup water. The evaporative liquid may be water.

A fan control mechanism 298 is also provided to preserve the evaporative coolant by matching the evaporation rate to the load. For instance, under light load conditions, the fan may not run at all.

The sump is designed to freeze without damage. In freezing conditions the unit may be operated on dry mode with fan only.

Referring now to FIG. 4, which is a detailed view of a housing, the lower portion of the housing is a sump 240 for containing the evaporative coolant. The sump includes a float valve 296 for providing evaporative coolant to the cooling tower. The sump is preferably constructed of a fiberglass reinforced plastic. The inlet and outlet manifolds, the drift eliminator 310, the spray nozzle piping 300, and the evaporative media 210 are supported by an internal PVC pipe frame 320 which rests in the sump. The outside of the cooling towers is preferably fiberglass reinforced wall sections 340 which are held together by corner clips 350. The design permits rapid and convenient access to the internals of the cooling tower from any side. The corner clips may be pried off with a screwdriver, and no other tools are required to remove the side panels of this embodiment. Alternatively, other frame and siding designs may be employed, such as bolting side panels to a frame.

In this embodiment, two of the side panels include air inlet vents 170 which permit air to be drawn into the unit. The vents are designed to permit air to enter the bottom of the vent without permitting light to enter the cooling tower, thereby reducing or eliminating algae growth in the tower, and eliminating the need to chemically conditioning the water.

Bleed off of a portion of the circulating water in the cooling tower may be used to help keep the dissolved solids concentration of the water below a maximum allowable limit. As a result of evaporation, dissolved solids concentration will generally increase up to a solubility limit unless reduced by bleed off.

The evaporative media is conventional high- efficiency cooling tower media such as that supplied by Brentwood Industries' CF 1200 media.

Over time, the outside of the heat exchangers may become fouled. The heat exchangers may be cleaned by spraying water over the corrugated tubes, or by flexing, shaking or striking the tubes to mechanically dislodge debris. Some flex tubes may have a galvanized threaded portion, and it is useful to apply heat shrink tubing over those fittings, then heat the tubing to form a protective plastic coating over the galvanized portion.

DESCRIPTION OF EMBODIMENT

Multiple Cooling Towers

Figure 5:
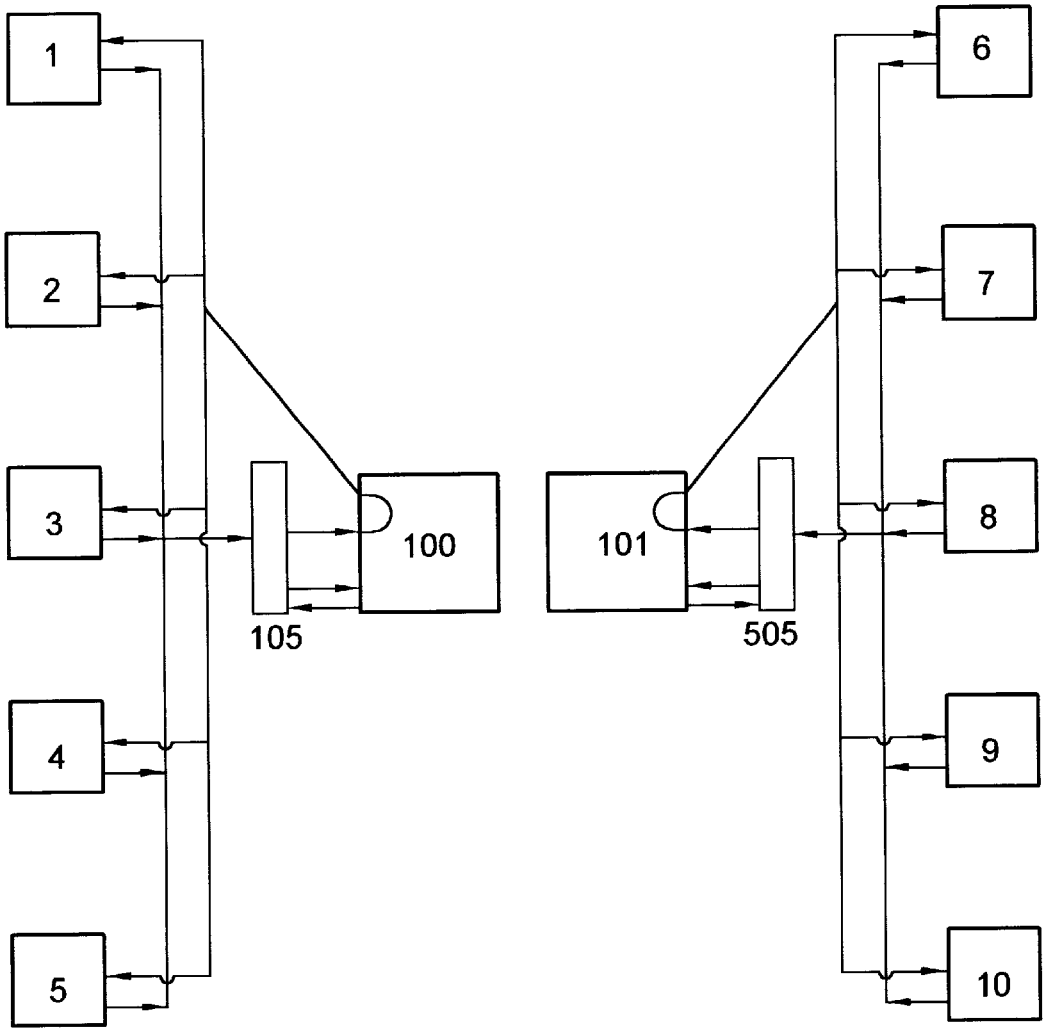
FIG. 5 is a schematic of a 10 zone rooftop air conditioning retrofit.

Referring now to FIG. 5 which is a schematic of a 10 zone rooftop air conditioning retrofit, this example replaces the 5-ton air conditioning units which provide air conditioning for a 18,000 square foot structure. Two twenty five ton fluid cooler modules evaporative fluid coolers 100 and 101 are installed, with the first unit serving air conditioning units 1 through 5; and the second unit serving air conditioning units 6 through 10. The first fluid cooler 100 is piped to a first pump module 105 and to the condensing heat exchangers of units 1–5. The second fluid cooler 101 is piped to a first pump module 505 and to the condensing heat exchangers of units 1–5. Each rooftop unit is taken out of service, and a new compressor module is installed, preferable on the existing housing, in order to provide minimum disruption to the roof. Each new housing includes a downsized compressor and a condensing heat exchanger as described in FIG. 2. The new housing may be a sheet metal housing or other material such as fiberglass.

Alternately, a single pump module may serve all rooftop units, and direct all process fluid through the first and then the second tower. In this embodiment, under low load, it may only be necessary to operate one of the cooling towers; while under high loads both towers may be necessary to cool the process fluid.

DETAILED DESCRIPTION OF EMBODIMENT

Geothermal Supplement

Figure 6:
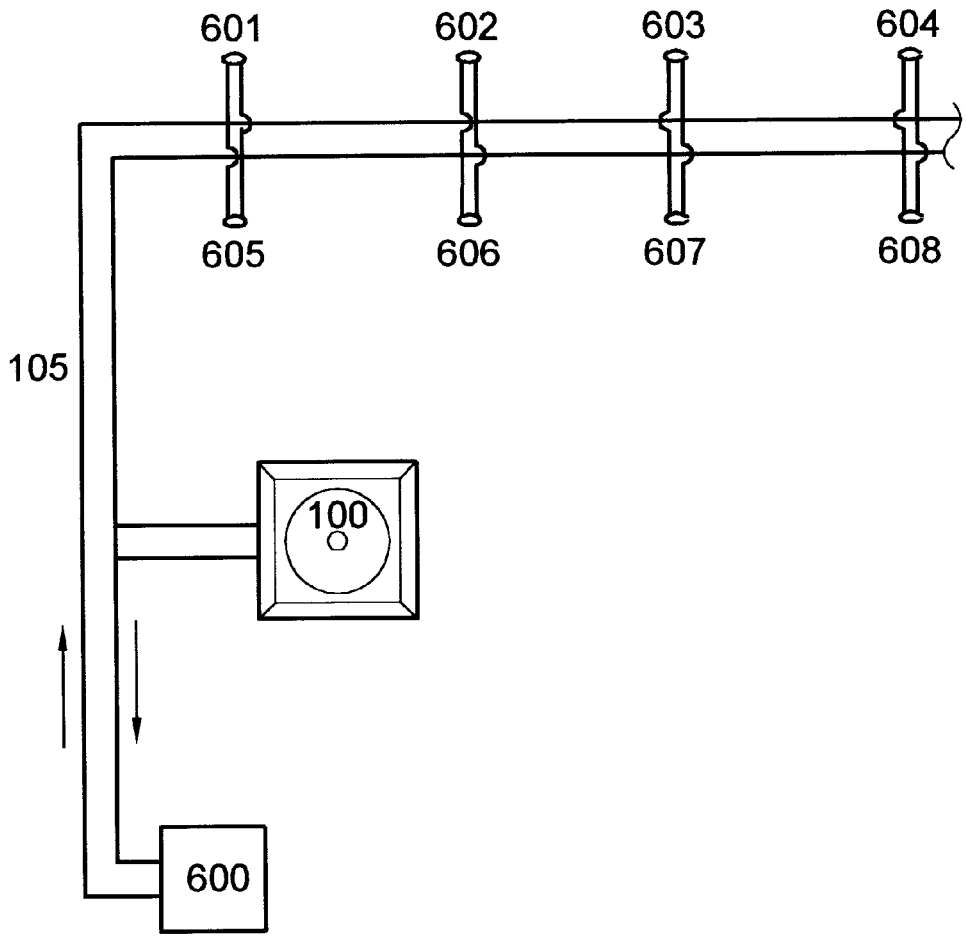
FIG. 6 is a schematic diagram of a geothermal heating system supplemented with a cooling tower.

Referring now to FIG. 6A, which is a schematic diagram of a geothermal heating system supplemented with a cooling tower, geothermal bore holes 601-608 are drilled in the proximity of a structure served by a water source heat pump unit 600. A process fluid 105 is circulated through the geothermal bore holes and the water source heat pump unit.

In the winter, the heat exchanger adds heat to air circulating through the structure, and that heat is supplied from the bore holes. As an example, eight bore holes are typically sufficient to heat a typical residential structure in the midwestern United States.

In the summer, the heat exchanger removes heat from the air circulating through the structure. Although eight bore holes were adequate for heating, typically 6 additional bore holes would be required to provide the cooling capacity for the example structure.

A more efficient method of cooling is to supplement the eight bore holes used for heating with a cooling tower and one or more air conditioning unit. In this approach, the peak demands of summer air conditioning can be supplied without the large capital cost of additional geothermal bore holes to meet the peak demand.

The cooling tower works as described in the above embodiments, with closed loop water 105 flowing through the evaporative tower 100 to remove heat from the freon or other refrigerant and releasing that heat in the cooling tower.

What is claimed is:

1. A heat exchange system for extracting heat from a process fluid comprising:

a plurality of heat sources; and at least one cooling tower, such that the cooling tower removes heat from more than one associated heat source, each cooling tower comprising a housing;

a process fluid inlet manifold;

a process fluid outlet manifold;

a process fluid circuit for each heat source associated with the cooling tower, the fluid circuit comprising inlet piping to deliver process fluid from the heat source to the inlet manifold, and outlet piping to deliver process fluid from the outlet manifold to the heat source;

a plurality of corrugated metal heat transfer tubes, such that each tube has a first end connected to the inlet manifold, and a second end connected to the outlet manifold;

a process fluid pumping means for forcing the process fluid from a heat source, through the inlet piping means, through the inlet manifold, through the heat transfer tubes, through the outlet manifold, and through the outlet piping means back to the heat source;

an evaporative coolant system comprising an evaporative coolant supply to the cooling tower, an evaporative coolant sump positioned within the housing, an evaporative coolant distribution means for distributing evaporative coolant onto the heat transfer tubes, an evaporative coolant pumping means for delivering coolant from the sump to the coolant distribution means;

an air distribution system comprising an air inlet for introducing air into the housing, an air exit for exhausting air from the housing, and an air moving device for forcing air across the heat transfer tubes; and at least one process fluid pump, such that the pump forces the process fluid from the heat sources, through the inlet piping means, through the inlet manifold, through the heat transfer tubes, through the outlet manifold, and through the outlet piping means back to the heat source.

2. The heat exchange system of claim 1 wherein:

there are plurality of cooling towers.

3. The heat exchange system of claim 1 wherein:

the system is installed on a rooftop.

4. The heat exchange system of claim 1 wherein:

the housing is fiberglass.

5. The heat exchange system of claim 1 wherein:

the heat transfer tubes are stainless steel.

6. The heat exchange system of claim 1 wherein:

the evaporative coolant is untreated water.

7. The heat exchange system of claim 1 wherein:

the heat sources are a plurality of air conditioning compressors, each compressor serving a refrigerant loop and having a heat exchanger, such that process fluid is directed through the heat exchanger in order to cool the refrigerant in the refrigerant loop.

8. An indirect evaporative cooling tower for extracting heat from a process fluid, the cooling tower comprising:

a non-metallic housing;

at least one process fluid circuit comprising an inlet manifold and an outlet manifold; inlet piping from at least one heat source to deliver process fluid from the heat source to the inlet manifold;

outlet piping from the outlet manifold to deliver process fluid from the outlet manifold to the heat source;

a plurality of corrugated metal heat transfer tubes, such that each tube has a first end connected to the inlet manifold, and a second end connected to the outlet manifold; an evaporative coolant system comprising an evaporative coolant supply to the cooling tower, an evaporative coolant sump positioned within the housing, an evaporative coolant distribution means for distributing evaporative coolant onto the heat transfer tubes, an evaporative coolant pumping means for delivering coolant from the sump to the coolant distribution means; and an air distribution system comprising an air inlet for introducing air into the housing, an air exit for exhausting air from the housing, and an air moving device for forcing air across the heat transfer tubes.

9. The cooling tower of claim 8 wherein the evaporative coolant distribution means further comprises a plurality of spray nozzles.

10. The cooling tower of claim 9 wherein the spray nozzles are high velocity, non-fading nozzles which provide a conical spray pattern.

11. The cooling tower of claim 8 wherein the air moving device is at least one fan.

12. The cooling tower of claim 8 wherein the air inlet means further comprises at least one vent in the lower portion of the housing such that air may enter the housing through the vent, and such that sunlight may not enter the housing.

13. The cooling tower of claim 8 wherein:

the cooling tower is installed on a rooftop.

14. The cooling tower of claim 8 wherein:

the housing is fiberglass.

15. The cooling tower of claim 8 wherein:

the heat transfer tubes are stainless steel.

16. The cooling tower of claim 8 wherein:

the evaporative coolant is selected from the group consisting of water, gray water, and salt water.

17. The cooling tower of claim 8 wherein:

the evaporative coolant is untreated water.

18. The cooling tower of claim 8 wherein:

the process fluid circuit includes at least one geothermal bore hole.

19. A heat exchanger for an indirect evaporative cooling tower for extracting heat from a process fluid, the heat exchanger comprising:

an inlet manifold;

an outlet manifold;

a plurality of corrugated metal heat transfer tubes, such that each tube has a first end connected to the inlet manifold, and a second end connected to the outlet manifold, such that the process fluid may be directed from the inlet manifold, through the tubes, to the outlet manifold, and such that an evaporative coolant and air may be introduced across the heat transfer tubes in order to provide evaporative cooling to the heat transfer tubes, and thereby cool the process fluid.

20. The heat exchanger of claim 19 wherein:

the heat transfer tubes are stainless steel.

21. The heat exchanger of claim 19 wherein:

the first end and the second end of the heat transfer tubes are threaded.

22. The heat exchanger of claim 19 wherein:

the inlet manifold is located in proximity to the outlet manifold; and the tubes are bent into approximately a U-shape, so that the tubes can be installed and removed from one side of the cooling tower.

23. A heat exchange element for an indirect evaporative cooling tower for extracting heat from a process fluid, the heat exchange element comprising:

a first end w with a threaded connection;

a second end with a threaded connection; and a corrugated metal tube connecting the first end and the second end, such that the process fluid may be directed from the first end through the tube to the second end, and such that an evaporative coolant and air may be introduced across the tube in order to provide evaporative cooling to the tube, and to thereby cool the process fluid.

24. The heat exchange element of claim 23 wherein:

the heat transfer tubes are stainless steel.

25. A water-cooled rooftop air conditioning system for a structure comprising:

a plurality of air conditioning units, each unit comprising an evaporator coil located within the structure, and a compressor and a heat exchanger located on the rooftop, such that a refrigerant is compressed by the compressor, then flows through the heat exchanger, and is then expanded in the evaporator coil;

at least one cooling tower, such that the cooling tower removes heat from more than one air conditioning unit, each cooling tower comprising a fiberglass housing;

a process fluid inlet manifold;

a process fluid outlet manifold;

a process fluid circuit for each air conditioning unit associated with the cooling tower, the fluid circuit comprising inlet piping to deliver process fluid from the heat exchanger of the air conditioning unit to the inlet manifold, and outlet piping to deliver process fluid from the outlet manifold to the heat exchanger of the air conditioning unit;

a plurality of corrugated stainless steel heat transfer tubes, such that each tube has a first end connected to the inlet manifold, and a second end connected to the outlet manifold;

a process fluid pump for forcing the process fluid from a heat source, through the inlet piping means, through the inlet manifold, through the heat transfer tubes, through the outlet manifold, and through the outlet piping means back to the heat source;

an evaporative coolant system comprising an evaporative coolant supply to the cooling tower, the evaporative coolant selected from the group consisting of water, gray water, or salt water, an evaporative coolant sump positioned within the housing, an evaporative coolant distribution means for distributing evaporative coolant onto the heat transfer tubes, an evaporative coolant pumping means for delivering coolant from the sump to the coolant distribution means;

an air distribution system comprising an air inlet for introducing air into the housing, such that air may enter the housing through the vent, and such that sunlight may not enter the housing, an air exit for exhausting air from the housing, and at least one fan for forcing air across the heat transfer tubes; and at least one process fluid pump, such that the pump forces the process fluid from the heat sources, through the inlet piping means, through the inlet manifold, through the heat transfer tubes, through the outlet manifold, and through the outlet piping means back to the heat source.

26. A method of extracting heat from a plurality of heat sources associated with a cooling tower, the method comprising providing at least one closed process fluid loop between the heat sources and the cooling tower; and for each process fluid loop, directing a portion of the process fluid through a heat exchanger for each heat source thereby removing heat from the heat source, directing the process fluid through a plurality of corrugated metal heat transfer tubes within the cooling tower; and providing an evaporative coolant and forced air to the exterior of the corrugated metal heat transfer tubes and to other portions of the cooling tower in order to facilitate evaporative cooling within the cooling tower, thereby lowering the temperature of the process fluid flowing through the heat transfer tubes.

27. The method of claim 26 further comprising locating the cooling tower on the roof of a structure.

28. A method of indirect evaporative cooling for extracting heat from a process fluid, the method comprising directing the process fluid through a plurality of corrugated metal heat transfer tubes positioned within a housing;

introducing air near the bottom of the housing and blowing the air upwards; and spraying an evaporative coolant onto to the exterior of the corrugated metal heat transfer tubes in order to facilitate evaporative cooling of the heat transfer tubes, thereby lowering the temperature of the process fluid flowing through the heat transfer tubes.

29. The method of claim 28 further comprising selecting the evaporative coolant from the group consisting of water, untreated water, and salt water.

30. A method of providing a water-cooled rooftop air conditioning system for a structure, the method comprising:

providing a plurality of air conditioning units, each unit comprising an evaporator coil located within the structure, and a compressor and a heat exchanger located on the rooftop;

circulating a refrigerant such the refrigerant is compressed by the compressor, then flows through the heat exchanger, and is then expanded in the evaporator coil; providing at least one cooling tower, such that the cooling tower removes heat from more than one air conditioning unit;

circulating a process fluid between each heat exchanger and a plurality of corrugated metal heat transfer tubes positioned within the cooling tower; and providing evaporative cooling to the heat transfer tubes.

31. A method of constructing a heat exchanger, the method comprising providing a first manifold;

providing a second manifold;

attaching the first end of a plurality of corrugated metal heat transfer tubes to the first manifold; and attaching the second end of a plurality of corrugated metal heat transfer tubes to the second manifold.

32. The method of claim 31 further comprising circulating a process fluid through the first manifold, heat transfer tubes, and second manifold; and providing cooling to the exterior of the heat transfer tubes.

* * * * *